United States Patent [19]

Norris et al.

[11] 4,433,539

[45] Feb. 28, 1984

[54] MEANS FOR CONTROLLING AIR SCAVENGE PRESSURE IN THE BEARING COMPARTMENT OF GAS TURBINES

[75] Inventors: James R. Norris, Bolton; Harrison R. Picard, Granby, both of Conn.

[73] Assignee: United Technologies Corporation, Hartford, Conn.

[21] Appl. No.: 377,746

[22] Filed: May 13, 1982

[51] Int. Cl.[3] ..... F02C 7/06

[52] U.S. Cl. ..... 60/39.08; 184/6.11

[58] Field of Search ..... 60/39.07, 39.08, 39.1; 184/6.11; 415/110, 111, 112, 175, 176

[56] References Cited

U.S. PATENT DOCUMENTS

| | | | |
|---|---|---|---|
| 3,171,354 | 3/1965 | Söhlemann | 415/175 X |
| 3,378,104 | 4/1968 | Venable | 60/39.08 |
| 3,884,041 | 5/1975 | Zerlauth | 60/39.08 X |

*Primary Examiner*—Louis J. Casaregola
*Assistant Examiner*—Donald E. Stout
*Attorney, Agent, or Firm*—Charles A. Warren

[57] ABSTRACT

In a gas turbine engine the vent for the bearing compartment has a restriction therein to control the airflow from the compartment and this restriction is variable in response to an engine parameter so as to control the pressure drop across the air seals for the compartment.

5 Claims, 3 Drawing Figures

MEANS FOR CONTROLLING AIR SCAVENGE PRESSURE IN THE BEARING COMPARTMENT OF GAS TURBINES

DESCRIPTION

1. Technical Field

A control for the bearing compartment pressure that will normally maintain the desired high pressure but will drop the pressure in the event of a pressure drop in the sealing air surrounding the bearing compartment.

2. Background Art

In many gas turbine engines it is desirable to maintain a relatively high pressure in the bearing compartment to control the influx of hot air normally surrounding such compartment to a level below which a fire might start in the event of a seal malfunction. At some operating conditions, for example flight idle, the pressure inside the compartment may approach, or possibly exceed the external pressure such that oil seepage may occur. It is desirable, therefore, to have some system to control the pressure in the bearing compartment relative to the external pressure while maintaining an acceptable pressure drop across the oil seals opposing leakage of oil at all engine operating conditions.

DISCLOSURE OF INVENTION

One feature is a valve in the scavenge/breather line which will reduce the flow area when the external air pressure is high and increases flow area when the pressure is low.

Another feature is the actuation of the valve by an engine parameter that is responsive to changes in engine conditions governing the pressure of the air surrounding the bearing compartment thus requiring no external control means.

According to the invention the restrictive valve in the scavenge system serves to control the pressure within the bearing compartment more or less linearly with the pressure external to the compartment so as to maintain a pressure drop across the seals consistent with seal operating characteristics which will provide good seal life, minimize oil leakage and minimize the possibility of a compartment fire in the event of a seal failure.

When an engine condition causes a drop in the pressure of the air surrounding the bearing compartment, this air being generally supplied from the compressor discharge and thus at substantially compressor discharge pressure, the drop in pressure may reduce the pressure drop across the seals so as to permit a reversal of pressure across the seals which result in leakage of oil past these seals. To maintain the desired pressure drop the restrictor valve is made responsive to an engine parameter that reflects or is a function of engine power or engine speed as for example in an engine with nonregulated oil pressure the pressure of the oil supplied to the bearing. With the oil pump driven from the engine shaft, oil pressure is a function of engine speed which, in accordance with the invention, will govern the position of the valve.

The foregoing and other objects features and advantages of the present invention will become more apparent in the light of the following detailed description of the preferred embodiments thereof as shown in the accompanying drawing.

BEST MODE FOR CARRYING OUT THE INVENTION

Figure 1:
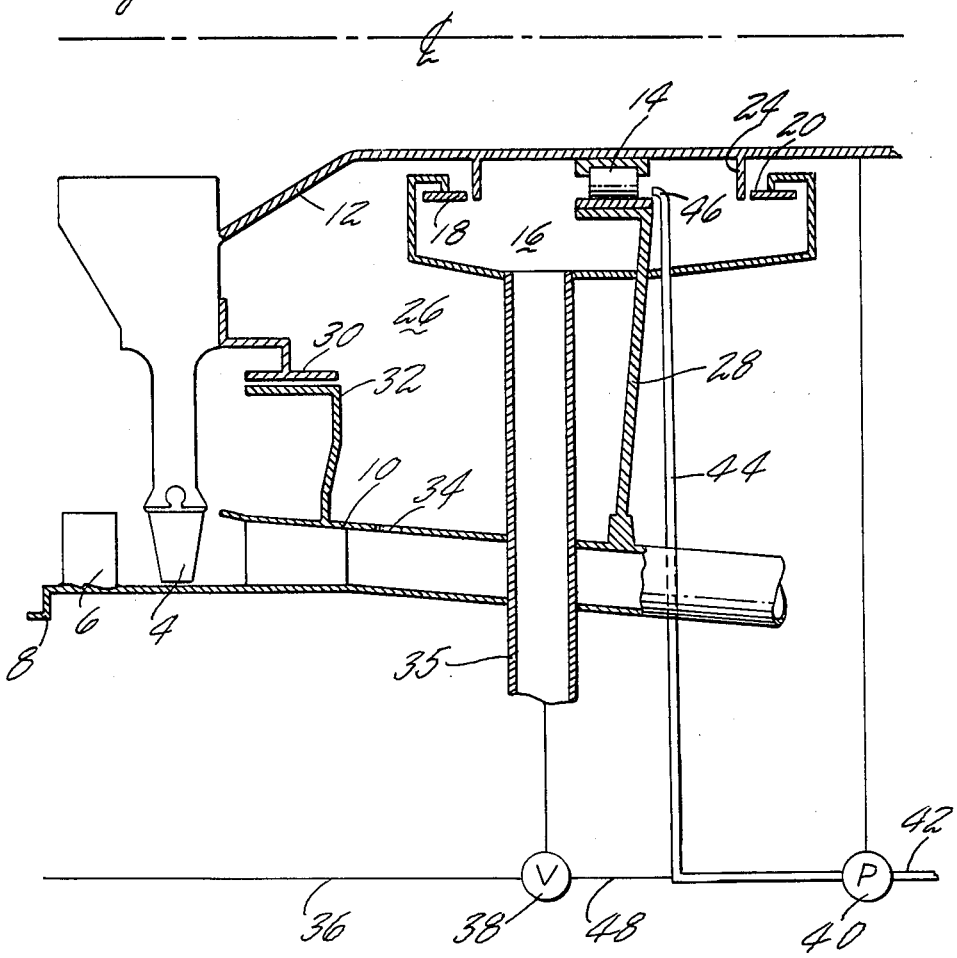
FIG. 1 is a diagrammatic view of a part of the engine showing the bearing compartment and seals with a restrictive valve of the invention.

The invention is shown as applied to a gas turbine engine having a compressor rotor 2 with blades 4 cooperating with a row of vanes 6 in a compressor casing 8. The drawing shows a compressor discharge end with the air discharging into a duct 10 leading to the combustion chambers. The rotor is carried by a shaft 12 supported in a bearing 14 in a compartment 16. Seals 18 and 20 at opposite ends of the compartment cooperate with flanges 22 and 24 on a shaft to seal the compartment and prevent oil leakage therefrom. Air under pressure is supplied from the compressor discharge to a chamber 26 surrounding a shaft. This chamber also encloses the bearing support structure 28 and the upper end of this chamber is defined by cooperating seal elements 30 and 32 into the chamber or it may be supplied to an opening 34 in the discharge duct 10. In either event the pressure in the chamber 26 is a direct function of the compressor discharge pressure. Depending upon the amount of leakage from the chamber 26, the pressure in this chamber may be substantially that of the compressor discharge pressure. The compartment 16 has a scavenge/-breather pipe 35 leading to a discharge line 36. In this line is a restrictive valve 38 which is shown in a restrictive position to limit the amount of air discharging from the bearing compartment and thus maintaining a pressure within the compartment at a selected pressure enough below that in the surrounding chamber 26 to limit the amount of air passing the seals through the compartment to the minimum amount required for proper functioning of the engine. This valve is made responsive to an engine parameter that is a function of power output or engine speed, for example, engine oil pressure in a nonregulated system. For this purpose the engine shaft drives a pump 40 that supplies lubricating oil from a supply pipe 42 through a discharge line 44 to spray oil against the bearing 14 through a nozzle 46. A branch line 48 from the pressure line 44 to a cylinder 50 (FIG. 2) having a piston 52 thereon supplies pressure for actuating the valve.

Figure 2:
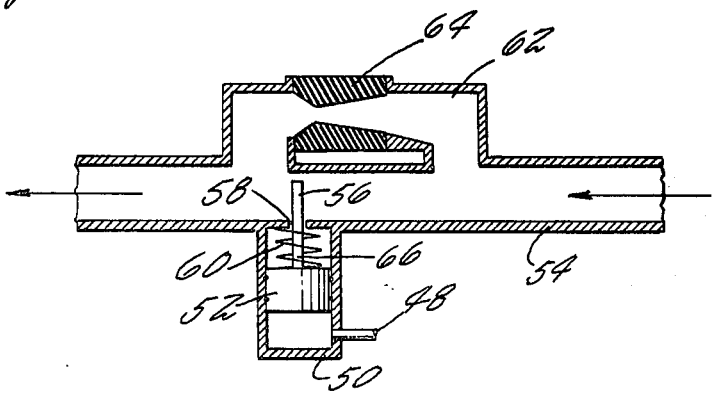
FIG. 2 is a detail of one form of restrictive valve.

Referring now to FIG. 2, the valve is in the form of a duct 54 in which there is positioned an obstructing gate 56 movable into and out of obstructing position in the duct to a slot 58 in the duct. A spring 60 normally holds the gate out of the obstructing position. In the bypass 62 around the gate there is a restrictive orifice 64 that controls the amount of air venting from compartment 16 when the valve is closed. This orifice may be changed to a different size orifice to change the amount of vented air.

The gate is attached to the piston 52 that is positioned in the cylinder 50 by a rod 66 and is urged into open position by a spring 60. Thus when there is a drop in oil pressure resulting from a reduction in speed of the engine rotor, the plate will be withdrawn from the duct to allow more air to vent from compartment 16 and produce a drop in pressure therein to match the corresponding drop in pressure in chamber 26 resulting from the same speed reductions.

Figure 3:
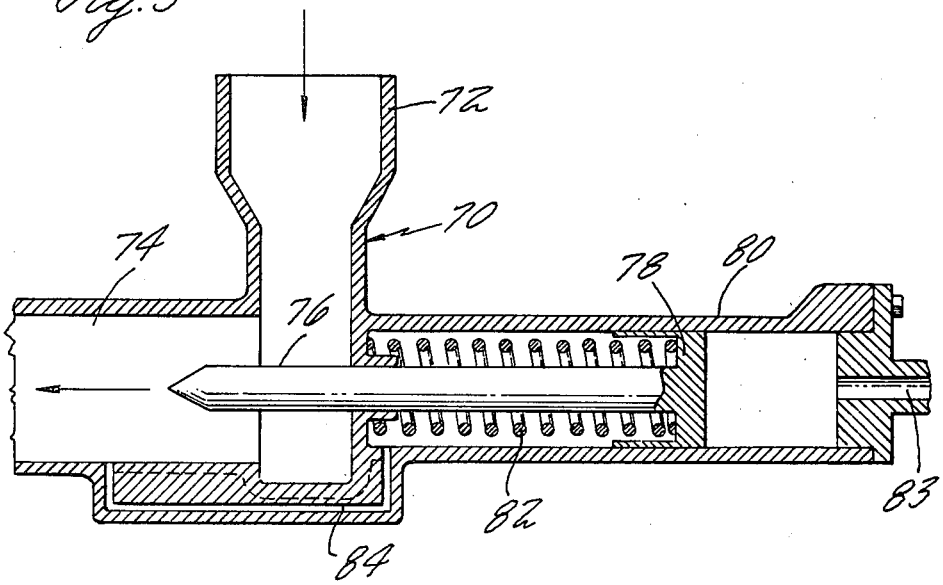
FIG. 3 is a detail of another form of restrictive valve.

As an alternative to the gate valve of FIG. 2 the valve structure 70 of FIG. 3 has an inlet 72 and an outlet 74 with a restrictive valve in the form of a rod 76 mounted on a piston 78 in the cylinder 80. The spring 82 normally urges the rod 76 out of the restrictive position shown and oil under pressure from the oil pump 40 of FIG. 1 entering the cylinder through duct 83 urges the rod into the restrictive position shown. A vent passage 84 allows any oil leaking past the piston to be discharged into the breather line.

As will thus be apparent from the structure of either of FIG. 2, or 3, the breather line for the compartment 16 has a restrictive valve therein which is responsive to the oil pressure supplied by the engine driven pump such that the pressure of the oil delivered by the pump is a nearly direct function of engine power or engine speed. In this way as the engine power or engine speed drops, the oil pressure will drop to such a degree that the restriction can be more or less withdrawn from the duct and thereby allow more air to be vented from compartment 16. The change of pressure of the oil delivered by the pump is obviously an engine parameter that is a function of or related to the change in power output or engine speed so that the valve restriction is reduced or eliminated by a drop in oil pressure. The effect of this reduction in the oil pressure and the corresponding reduction in the restrictive effect of the valve was to allow the proper venting of air from the compartment 16 at reduced pressure as the oil pressure drops so that there cannot be a reversal of pressure across the seals by reason of the pressure within the compartment 16 becoming higher than that in the surrounding chamber 26 as the pressure in chamber 26 is reduced or dropped as a result of the decrease in engine power or engine speed.

We claim:

1. In a gas turbine having a rotor and a compressor discharge passage for compressor discharge air:

a bearing for the rotor;

a compartment surrounding the bearing;

seals cooperating with the compartment to prevent leakage of oil from said compartment;

means for supplying compressor discharge air from said passage to said seals exteriorly of the compartments;

a vent duct for the compartment;

a restrictive valve in said duct by which to vary the discharge of air from said compartment; and means responsive to rotor speed for actuating said restrictive valve.

2. A gas turbine engine having a rotor and a compressor discharge passage for compressor discharge air;

a bearing for the rotor;

a compartment surrounding the bearing;

seals cooperating with the compartment to prevent leakage of oil from said compartment;

means for supplying compressor discharge air from said passage to said seals exteriorly of the compartment;

a vent duct for the compartment;

a restrictive valve in said duct by which to vary the discharge of air from said compartment;

a pump driven by said rotor for supplying lubricant under pressure to the bearing; and means responsive to said oil under pressure for actuating said restrictive valve.

3. A gas turbine engine as in claim 2 in which the means responsive to oil under pressure from said pump functions for reducing the restriction in response to a drop in oil pressure.

4. A gas turbine engine as in claim 2 including a piston and cylinder with the piston connected to said restrictive valve and with the cylinder supplied with oil under pressure from said pump.

5. A gas turbine engine as in claim 4 including a spring for urging the restrictive valve into nonrestricting position.

* * * * *